United States Patent [19]

Lee

[11] Patent Number: 4,912,608

[45] Date of Patent: Mar. 27, 1990

[54] FLICKERING ORNAMENTAL DEVICE WITH A VARIABLE OUTER APPEARANCE

[76] Inventor: Sam S. Lee, 12F, No. 603, Tun-Hwa S. Rd., Taipei City, Taiwan

[21] Appl. No.: 399,069

[22] Filed: Aug. 24, 1989

[51] Int. Cl.[4] ..... F21L 15/08

[52] U.S. Cl. ..... 362/1045; 362/806

[58] Field of Search ..... 362/103, 104, 806

[56] References Cited

U.S. PATENT DOCUMENTS

| | | | |
|---|---|---|---|
| 4,096,552 | 6/1978 | Ben-Porat | 362/104 |
| 4,101,955 | 7/1978 | DuNah | 362/104 |
| 4,556,932 | 12/1985 | Lehrer et al. | 362/104 X |
| 4,638,409 | 1/1987 | Berman | 362/104 |
| 4,777,408 | 10/1988 | DeLuca | 362/104 X |

*Primary Examiner*—Allen M. Ostrager

*Attorney, Agent, or Firm*—Harness, Dickey & Pierce

[57] ABSTRACT

A flickering ornamental device includes a combination of a fundamental unit and a locket structure wherein the fundamental unit is composed of a mounting seat and a PC board, having a flickering circuit and a lamp unit electrically disposed therein for effecting intermittent flickering operations therewith; while said locket structure is composed of a case frame, which has a variable outer appearance adapted for ornamental purposes, a screen member with letters or figures captioned thereon, a reflecting plate and a base member provided in conjunction with the mounting seat and the PC board; whereby, when the flickering circuit is energized, intermittent flickering of the letters or figures will be effected in the locket structure.

4 Claims, 5 Drawing Sheets

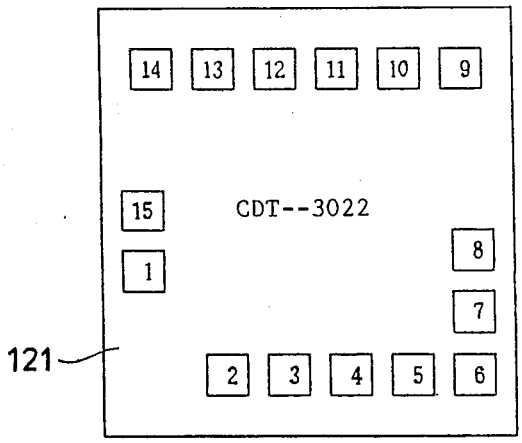

CHIP SIZE: 60 X 60 MIL
(1.52 / 1.52 mm)

FIG. 3A

FUNCTIONAL TABLE OF THE IC CHIP

| PIN NO. | SYMBOL | FUNCTION EXPLANATION |
|---|---|---|
| 1 | OSC1 | OUTPUT OF OSCILLATOR1 |
| 2 | ONE-SHOT | FLICKERING OUTPUT AT A FIXED TIME |
| 3 | TIMER | OUTPUT OF A TIMER |
| 4 | VDD | POSITIVE TERMINAL |
| 5 | RD/$\widetilde{SO}$ | FLICKERING SELECTION, RANDOM/SEQ |
| 6 | ON/OFF | SWITCHING SELECTION, FLICKER/STOP |
| 7 | TEST | INTERNAL TEST |
| 8 | Vss | NEGATIVE POWER |
| 9 | LAMP6 | LED6 LAMP OUTPUT |
| 10 | LAMP5 | LED5 LAMP OUTPUT |
| 11 | LAMP4 | LED4 LAMP OUTPUT |
| 12 | LAMP3 | LED3 LAMP OUTPUT |
| 13 | LAMP2 | LED2 LAMP OUTPUT |
| 14 | LAMP1 | LED1 LAMP OUTPUT |
| 15 | OSC2 | OUTPUT OF OSCILLATOR2 |

FIG. 3B

FLICKERING ORNAMENTAL DEVICE WITH A VARIABLE OUTER APPEARANCE

BACKGROUND OF THE INVENTION

This invention relates to an ornamental device, and more particularly to a flickering ornamental device the outer appearance of which can be varied so as to increase the appeal thereof.

Ornamental articles are widely available for personal use not only as consumer items, but also as gift and marketing promotion items. In order to satisfy the varied taste of consumers, a wide variety of forms and patterns of known ornamental articles are offered on the market. However, since conventional ornamental articles are usually provided with static patterns and fixed outer forms, their appeal quickly fades in view of limited ornamentation effect provided thereby.

SUMMARY OF THE INVENTION

It is accordingly a primary object of the present invention to provide a flickering ornamental device with a variable outer appearance so as to increase the appeal thereof.

It is another object of the present invention to provide a flickering ornamental device with a variable outer appearance for promoting a commercial advertising effect therewith.

These and other objects of the present invention are achieved by the provision of a flickering ornamental device with a variable outer appearance, said flickering ornamental device comprising a combination of a fundamental unit and a locket structure. The fundamental unit includes: a mounting seat with a receiving chamber in the front side thereof and a battery cavity in the back side thereof; a pair of retaining stubs provided on a top edge of said mounting seat for being attached to a necklace; a push-button switch and a power source disposed in said mounting seat for respectively activating and maintaining flickering control operations therewith; a printed circuit (PC) board, having a flickering integrated circuit (IC) disposed therein installed in the receiving chamber of said mounting seat and electrically coupled therewith for generating intermittent flickering signals therefrom; and a lamp unit installed on said PC board and electrically connected to the output of said flickering IC for being energized to flicker thereat. The locket structure, which can be manufactured in different forms, comprises: a case frame with a transparent surface on one side and an open section in the other side thereof; a screen member fixed in the open side of said case frame for providing different patterns therewith; a reflecting member having a lamp aperture formed therein located over said screen member; and a base plate having an opening formed therein and a plurality of retaining means provided on a back side thereof detachably connected to the open side of said case frame over said reflecting member; whereby, when said fundamental unit and said locket structure are detachably combined together so that said light emitting means is located in the opening of said base plate, by turning on the push-button switch on said fundamental unit, the screen member in said case frame will intermittently flicker thereat.

Other advantages and characteristics of the present invention will be apparent from the following detailed description of a preferred embodiment when read in conjunction with the accompanying drawings.

BRIEF DESCRIPTION OF THE DRAWINGS

FIG. 3A is a block diagram of a flickering IC chip adapted in the preferred embodiment;

FIG. 3B is a functional table of the flickering IC chip, indicating the functions of each pin of the flickering IC chip shown in FIG. 3A;

DETAILED DESCRIPTION OF THE PREFERRED EMBODIMENT

Referring to FIGS. 1A, 1B, 2A and 2B, the preferred embodiment of a flickering ornamental device according to the present invention comprises a combination of a fundamental unit 10 and a locket structure 20.

Figure 1A:
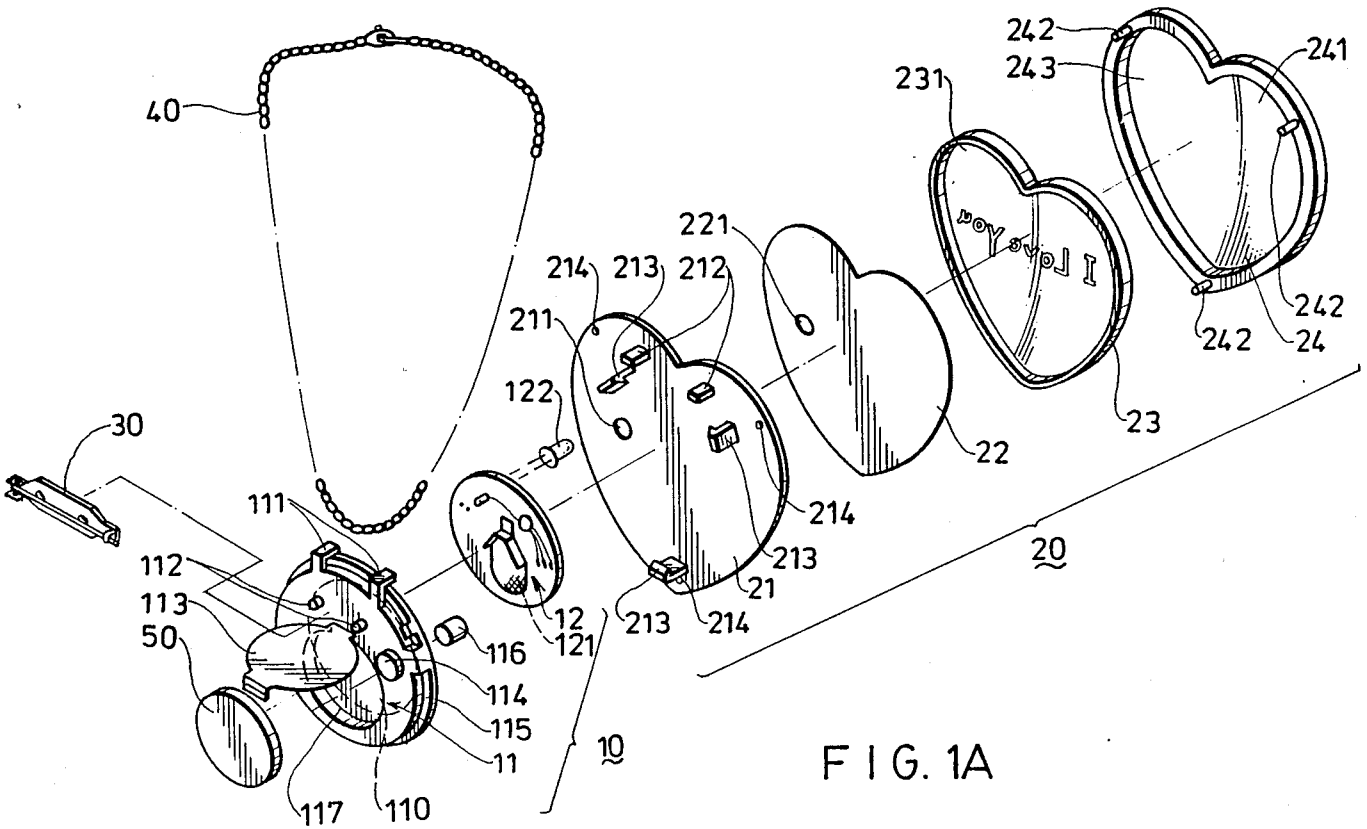
FIG. 1A is an exploded and perspective view of a preferred embodiment of a flickering ornamental device with a variable outer appearance according to the present invention.

As shown in FIG. 1A, the fundamental unit 10 is compose of a mounting seat 11 and a printed-circuit (PC) board 12. Said mounting seat 11, which is integrally formed with a receiving chamber 110 in the front side thereof, a pair of L-shaped retaining lugs 111 symmetrically located on a top edge thereof, a battery cavity 117 in the back side thereof, and a flange 115 located around the periphery of the front side, includes: a push-button switch 114 electrically installed in the back side of said mounting seat 11; a cover 113 movably attached onto the back side of said mounting seat 11 for covering said battery cavity 117; a mercury cell 50 disposed in said battery cavity 117 for supplying a power source therefrom; a contact member 116 provided under the lower end of said push-button switch 114; and a safety pin 30 fixed on a pair of protuberances 112 located on the back side of said mounting seat 11.

The PC board 12, having a flickering IC chip 121 and a lamp unit 122 electrically disposed therein, is installed in the receiving chamber 110 of said mounting seat 11 and electrically coupled therewith.

Figure 1B:
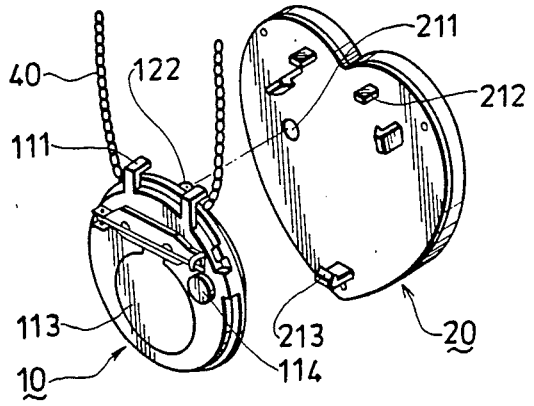
FIG. 1B is a perspective view of the preferred embodiment of FIG. 1 showing a fundamental unit and a locket structure thereof separately assembled for being combined therewith.

The locket structure 20 comprises: a case frame 24 having a transparent surface 241 provided on one side thereof and an open section 243 in the other side thereof with a plurality of retaining posts 242 separately located along the edge of said open section 243; a screen member 23 which comprises a transparent screen 231 for being used to caption letters or figures thereon, installed in the open section 243 of said case frame 24; a reflecting plate 22 having a lamp opening 221 formed therein positioned on said screen member 23; and a base member 21, having a lamp aperture 211 formed therein in conjunction with the lamp opening 221 of said reflecting plate 22, and having a pair of stop blocks 212 and a plurality of holding tabs 213 and retaining holes 214 separately provided on one side thereof, connected to the open section 243 of said case frame 24 through said retaining posts 242 thereof and said retaining holes 214 of said base member 1. The separately assembled fundamental unit 10 and locket structure 20 are as shown in FIG. 1B.

Figure 2A:
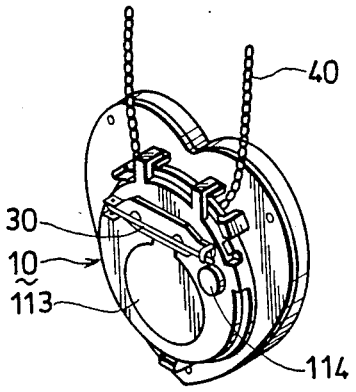
FIGS. 2A and 2B are perspective views respectively showing the back side and the front side of the combined preferred embodiment.
Figure 2B:
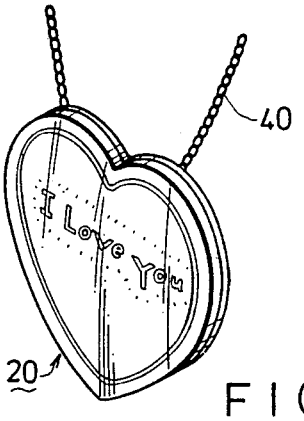

As shown in FIGS. 2A and 2B, the assembled fundamental unit 10 and the locket structure 20 are combined by respectively engaging the holding tabs 213 of said base member 21 with the flange 115 of said mounting seat 11, and the L-shaped retaining lugs 111 of said mounting seat 11 with the stop blocks 212 of said base member 21, so that the front portion of the lamp unit 122 of said IC board 12 extends through the lamp aperture 211 of said base member 21. The combined fundamental unit 10 and the locket structure 20 can either be worn around a user's neck by means of the necklace 40, which is movably held in the space defined by the retaining lugs 111 and the stop blocks 212, or detachably fixed on an article of clothing via the safety pin 30. By pressing the push-button switch 114 of said fundamental unit 10, the lamp unit 122 can be made to intermittently flicker within said locket structure 20 so that the captioned letters or patterns provided on the transparent screen 231 of said screen member 23 will in turn intermittently flicker, providing a dynamic advertisement, as well as an ornamental effect therewith.

Figure 3C:
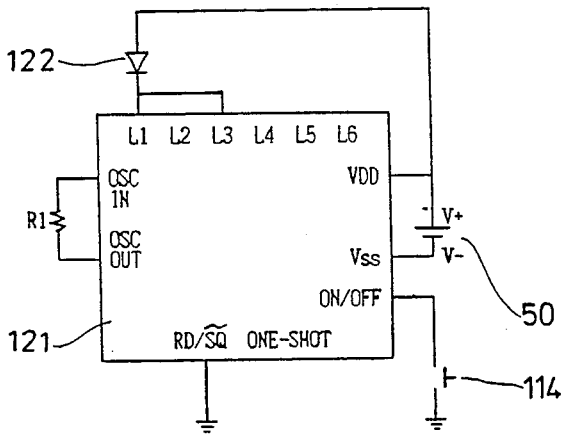
FIG. 3C is a flickering circuit diagram of the preferred embodiment.

Referring to FIGS. 3A, 3B and 3C, the flickering IC chip 121 adapted in the preferred embodiment is a fifteen-pin CMOS IC chip,(such as the known CDT-3022 chip), as shown in FIG. 3A, wherein the function of each pin of said IC chip 121 is identified in the function table of FIG. 3B.

The flickering circuit arrangement in the preferred embodiment is as shown in FIG. 3C wherein the fifth pin RD/SQ of said flickering IC chip 121 is grounded to enable the six outputs L1–L6, (pin 9 through pin 14), of said lamp unit 122, ( which is shown electrically connected to the outputs L3, L1), to be sequentially flickered thereat, symbolizing the beating of a heart through said locket structure 20 so as to achieve an amazing effect therewith.

Figure 4B:
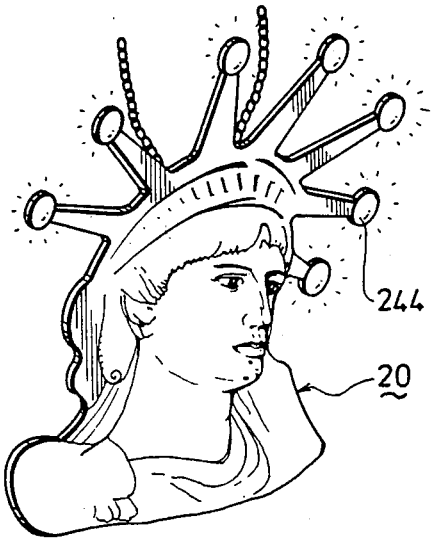
FIG. 4B is an illustration of the assembled alternative example of the preferred embodiment of FIG. 4A, indicating a flickering condition therewith.
Figure 4A:
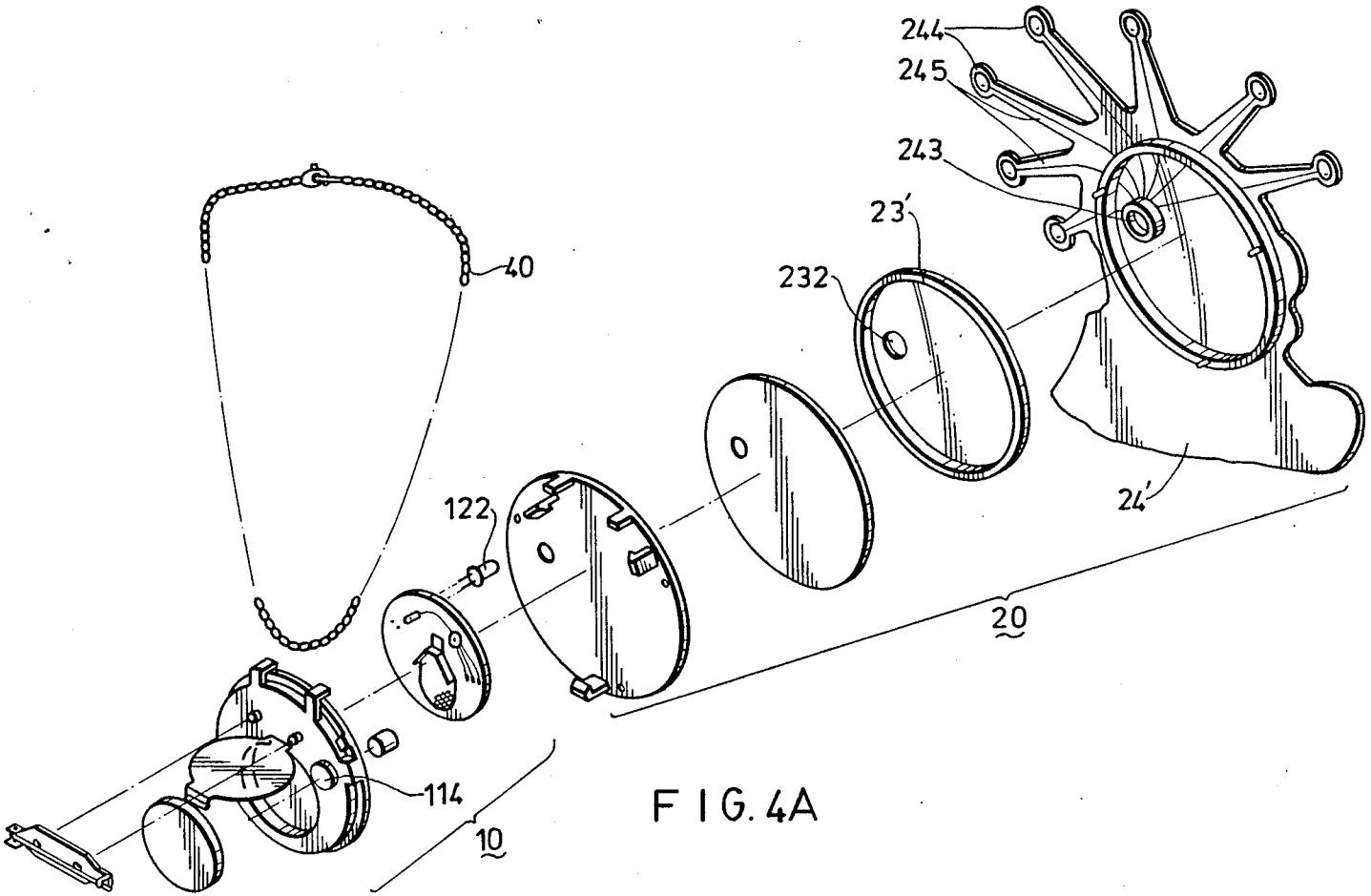
FIG. 4A is an exploded and perspective view of an alternative example of the preferred embodiment according to the present invention.

Referring to FIGS. 4A and 4B, an alternative example of the preferred embodiment of a flickering ornamental device according to the present invention is shown wherein the arrangement of all the structural elements is the same as that described hereinbefore and illustrated in FIGS. 1 through 3, except that the case frame 24' of said locket structure 20 has been modified in a shape resembling that of a bust of Lady Liberty. Said case frame 24' includes a light channel 243 leading to each transparent steeple 244 of the crown thereof, and a light fiber 245 is installed between the light channel 243 and each transparent steeple 244. In addition, the screen member 23' is also provided with a light opening formed in conjunction with the light channel 243 of said case frame 24. After the fundamental unit 10 and the locket structure 20 are combined together, the lamp unit 122 of said fundamental unit 10 will be exposed in the light channel 243 through the light opening 232 of said screen member 23. Therefore, when the push-button switch 114 is turned on, the flickering light produced from said lamp unit 122 will be transmitted into each light fiber 245, causing each end of said light fibers 245 to produce light thereat. Thus, each transparent steeple 244 will flicker at the head of said bust-like locket structure 20, as shown in FIG. 4B.

It shall be appreciated that the locket structure 20 adapted in the preferred embodiment according to the present invention can be produced in a variety of forms depending on the desires of the manufactures, without involving any changes to said fundamental unit 10. Moreover, various patterns or figures can also be provided on the transparent screen 231 of said screen member 23.

While a preferred embodiment has been illustrated and described, it will be apparent that many changes may be made in the general construction and arrangement of the present invention without departing from the spirit and scope thereof. It is therefore desired that the present invention not be limited to the exact disclosure, but only to the extent of the appended claims.

What is claimed is:

1. A flickering ornamental device comprising:

a fundamental unit which is composed of a mounting seat and a printed-circuit (PC) board, said mounting seat including a flange provided along a periphery thereof, a receiving chamber formed in a front side thereof for accommodating said PC board therein, a battery cavity provided in a back side thereof for electrically installing a mercury cell therein so as t provide a power supply therefrom, a cover movably attached onto the back side of said mounting seat for covering said battery cavity, and a push-button switch provided on the back side of said mounting seat and electrically coupled with said mercury cell thereat; said PC board including a flickering integrated-circuit (IC) chip disposed therein for being activated to transmit flickering signals therefrom, and a lamp unit disposed in said PC board and electrically connected to said flickering IC chip for being energized to emit flickering light thereat; and a locket means, having a variable outer appearance adapted for ornamental purposes, detachably connected to said fundamental unit in conjunction with said lamp unit thereof; whereby, when said push-button switch is turned on, said locket means will intermittently flicker thereat.

2. A flickering ornamental device according to claim 1 wherein said mounting seat further comprises a pair of protuberances located on the back side thereof so as to arrange a safety pin thereon for attachment purposes.

3. A flickering ornamental device according to claim 1 wherein said locket means comprises:

a case frame, which can be adapted to any ornamental shape, including a transparent surface provided on one side thereof, an open section in the other side thereof and a plurality of retaining posts separately located along the edge of said open section;

a screen member, having a transparent screen thereof provided for captioning letters or figures thereon, installed in the open section of said case frame with said transparent screen being situated against said transparent surface for posting said letters or figures thereto;

a reflecting plate having a lamp opening formed therein positioned on said screen member for reflecting said letters or figures on the transparent surface of said case frame;

a base member, having a lamp aperture formed therein in conjunction with the lamp opening of said reflecting plate, and also having a pair of stop blocks and a plurality of holding tabs and retaining holes separately provided on one side thereof, connected to the open section of said case frame through said retaining posts thereof and said retaining holes of said base member 1 so as to be detachably connected to said fundamental unit through said stop blocks and said holding tabs.

4. A flickering ornamental device according to claim 1 wherein said mounting seat further comprises a pair of L-shaped retaining lugs symmetrically located on a top edge thereof for being separately engaged with the stop blocks of said base member so as to define a space therein for movably receiving a necklace therethrough.

* * * * *